US011158475B2

(12) United States Patent
Yao et al.

(10) Patent No.: US 11,158,475 B2
(45) Date of Patent: Oct. 26, 2021

(54) RELAY

(71) Applicant: BYD COMPANY LIMITED, Guangdong (CN)

(72) Inventors: Baotong Yao, Shenzhen (CN); Caili Huang, Shenzhen (CN); Siyuan Liu, Shenzhen (CN); Lujian Wang, Shenzhen (CN)

(73) Assignee: BYD COMPANY LIMITED, Guangdong (CN)

( * ) Notice: Subject to any disclaimer, the term of this patent is extended or adjusted under 35 U.S.C. 154(b) by 539 days.

(21) Appl. No.: 16/083,876

(22) PCT Filed: Mar. 17, 2017

(86) PCT No.: PCT/CN2017/077156
§ 371 (c)(1),
(2) Date: Sep. 10, 2018

(87) PCT Pub. No.: WO2017/157342
PCT Pub. Date: Sep. 21, 2017

(65) Prior Publication Data

US 2020/0294747 A1 Sep. 17, 2020

(30) Foreign Application Priority Data

Mar. 18, 2016 (CN) ..... 201610161252.1

(51) Int. Cl.
*H01H 50/08* (2006.01)
*H01H 50/54* (2006.01)
(Continued)

(52) U.S. Cl.
CPC ..... *H01H 50/546* (2013.01); *H01H 50/04* (2013.01); *H01H 50/541* (2013.01); *H01H 50/58* (2013.01); *H01H 2050/049* (2013.01)

(58) Field of Classification Search
CPC .. H01H 1/20; H01H 9/0066; H01H 2050/049; H01H 50/08; H01H 50/541; H01H 50/546
See application file for complete search history.

(56) References Cited

U.S. PATENT DOCUMENTS 6,611,416 B1 8/2003 Cleereman et al.

FOREIGN PATENT DOCUMENTS

| | | |
|---|---|---|
| CN | 202394817 U | 8/2012 |
| CN | 104810207 A | 7/2015 |
| JP | H0581988 A | 4/1993 |

OTHER PUBLICATIONS

International Search Report from PCT/CN2017/077156 dated Jun. 2, 2017 (2 pages).

*Primary Examiner* — Ramon M Barrera
(74) *Attorney, Agent, or Firm* — Calfee Halter & Griswold LLP

(57) ABSTRACT

The subject matter discloses a relay, including a housing, static contact bridges, a moving contact bridge, a pushing mechanism and a detection assembly. The static contact bridges is arranged on the housing, the moving contact bridge is movably arranged in the housing between a conduction position where the moving contact bridge is conducted with the static contact bridges and a disconnection position where the moving contact bridge is disconnected from the static contact bridges, and the pushing mechanism is connected with the moving contact bridge and used for pushing the moving contact bridge to move between the conduction position and the disconnection position; the detection assembly comprises an auxiliary moving contact bridge and an auxiliary static contact bridge, the auxiliary moving contact bridge is connected with the pushing mechanism, the auxiliary static contact bridge is arranged on the housing, the auxiliary moving contact bridge is connected
(Continued)

with the auxiliary static contact bridge when the moving contact bridge is at the conduction position, and the auxiliary moving contact bridge is disconnected from the auxiliary static contact bridge when the moving contact bridge is at the disconnection position.

19 Claims, 8 Drawing Sheets

(51) Int. Cl.
*H01H 50/04* (2006.01)
*H01H 50/58* (2006.01)

RELAY

CROSS-REFERENCE TO RELATED APPLICATIONS

This application is a 371 of PCT Application No. PCT/CN2017/077156 filed on Mar. 17, 2017, which claim priority to Chinese Application No. 201610161252.1 filed on Mar. 18, 2016, the contents of which are hereby incorporated by reference as if recited in their entirety.

TECHNICAL FIELD

The present application relates to the technical field of electrical appliances, in particular to a relay.

BACKGROUND

In a relay of related technology, after the contacts of the relay are attracted and coupled to each other, no corresponding detection assembly is used for judging and detecting whether the contacts are conducted. Once the contacts are not conducted or the contacts are stuck, it is difficult to quickly detect and feed back problems when the relay is used.

SUMMARY

The present subject matter aims to solve one of the technical problems in the related technology at least to some extent. To this end, the present subject matter consists in proposing a relay that can detect whether contacts are conducted and has high reliability.

A relay according to an embodiment of the present subject matter includes: a housing; static contact bridges, arranged on the housing; a moving contact bridge, movably arranged in the housing between a conduction position where the moving contact bridge is conducted with the static contact bridges and a disconnection position where the moving contact bridge is disconnected from the static contact bridges; a pushing mechanism, connected with the moving contact bridge and used for pushing the moving contact bridge to move between the conduction position and the disconnection position; a detection assembly, including an auxiliary moving contact bridge and an auxiliary static contact bridge, wherein the auxiliary moving contact bridge is connected with the pushing mechanism, the auxiliary static contact bridge is arranged on the housing, the auxiliary moving contact bridge is connected with the auxiliary static contact bridge when the moving contact bridge is at the conduction position, and the auxiliary moving contact bridge is disconnected from the auxiliary static contact bridge when the moving contact bridge is at the disconnection position.

The pushing mechanism includes an upper end and a lower end, the upper end of the pushing mechanism is arranged inside the housing, and the lower end of the pushing mechanism is arranged outside the housing.

According to the relay of the embodiment of the present subject matter, non-conduction or sticking failure of the moving contact bridge and the static contact bridges can be quickly detected on a circuit where the relay is located through the auxiliary moving contact bridge and the auxiliary static contact bridge, thus, whether the moving contact bridge is conducted with the static contact bridges can be detected and fed back in time, and the operational reliability and safety of the relay can be improved.

According to an embodiment of the present subject matter, the auxiliary moving contact bridge is an elastic sheet, the auxiliary static contact bridge includes two wires arranged at an interval, and the elastic sheet conducts the two wires when the moving contact bridge is at the conduction position.

Further, through holes are formed in the housing, a metalized layer is formed on the inner surfaces of the through holes, and the wires are inserted into the through holes and electrically connected with the metalized layer.

According to some embodiments of the present subject matter, the housing is in the shape of a frame with an open lower end, the static contact bridges and the auxiliary static contact bridge are arranged on the top wall of the housing, and an upper yoke is connected to the lower end of the housing.

Further, the pushing mechanism includes: a moving core; a drive shaft, wherein the lower end of the drive shaft is connected with the moving core and the relative position therebetween is fixed, a static core extending down and sleeved outside the drive shaft is arranged on the upper yoke, and the upper end of the drive shaft penetrates through the static core and is connected with the moving contact bridge; and a reset spring, wherein the reset spring is sleeved outside the drive shaft and the two ends are respectively connected with the moving core and the static core.

Further, a sleeve is arranged below the upper yoke, the sleeve is sleeved outside the static core, and the moving core is slidably sleeved in the sleeve along the upper and lower direction.

Optionally, a mounting hole is formed in the moving contact bridge, the upper end of the drive shaft penetrates through the mounting hole, and the moving contact bridge is provided with: an upper insulating cover, arranged on the moving contact bridge and sleeved outside the drive shaft, the lower end of the upper insulating cover stretching into the mounting hole; and a lower insulating cover, arranged below the moving contact bridge and sleeved outside the drive shaft, the upper end of the lower insulating cover stretching into the mounting hole and sleeved on the outer side surface of the lower end of the upper insulating cover, and the upper insulating cover being in interference fit with the lower insulating cover.

Further, a washer and a clamping spring are arranged at the upper end of the drive shaft, and the washer is arranged between the clamping spring and the upper insulating cover.

Optionally, a limiting flange is provided on the peripheral surface of the portion of the drive shaft extending upwardly out of the upper yoke, a buffer spring is sleeved on the outer side of the drive shaft, the upper end of the buffer spring is connected with the lower insulating cover and the lower end of the buffer spring is connected with the limiting flange.

Optionally, the auxiliary moving contact bridge and the upper insulating cover are integrally molded by injection molding.

In some embodiments of the present subject matter, an upper insulating cover and a lower insulating cover are arranged between the drive shaft and the moving contact bridge, and the auxiliary moving contact bridge is arranged on the upper insulating cover.

According to some embodiments of the present subject matter, the auxiliary moving contact bridge is arranged at the upper end of the pushing mechanism.

In some embodiments of the present subject matter, the auxiliary moving contact bridge is arranged at the upper end of the drive shaft.

REFERENCE NUMBER

Figure 1:
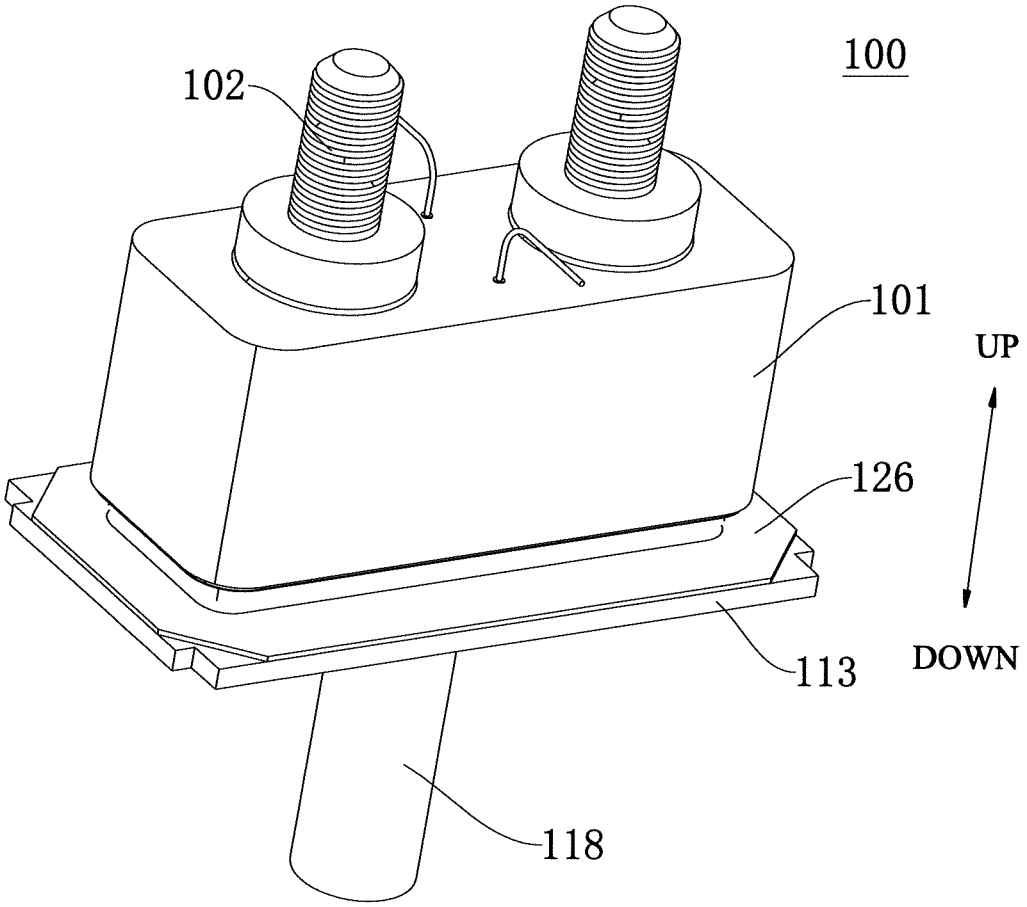
FIG. 1 is a schematic diagram of a relay according to an embodiment of the present subject matter.

Relay 100, housing 101, static contact bridge 102, moving contact bridge 103, pushing mechanism 104, detection assembly 105, auxiliary moving contact bridge 106, auxiliary static contact bridge 107, through hole 110, housing top wall 111, housing lower end 112, upper yoke 113, moving core 114, drive shaft 115, reset spring 116, static core 117, sleeve 118, mounting hole 119, upper insulating cover 120, lower insulating cover 121, washer 122, clamping spring 123, limiting flange 124, buffer spring 125, connecting table 126, limiting turn-up edge 128, annular card slot 129, matching hole 130, first boss 131, second boss 132, and positioning hole 133.

DETAILED DESCRIPTION OF THE EMBODIMENTS

The embodiments of the present subject matter will be described in detail below. Examples of the embodiments are shown in the accompanying drawings. The same or similar reference numbers throughout the drawings denote the same or similar elements or the elements having same or similar functions. The embodiments described below with reference to the accompanying drawings are exemplary and are intended to explain the present subject matter, but should not be understood as limiting the present subject matter.

A relay 100 according to an embodiment of the present subject matter will be described in detail below with reference to FIGS. 1 to 10.

Referring to FIGS. 1 to 10, the relay 100 according to an embodiment of the present subject matter includes a housing 101, static contact bridges 102, a moving contact bridge 103, a pushing mechanism 104 and a detection assembly 105.

Specifically, in combination with FIG. 1 to FIG. 5, the static contact bridges 102 may be arranged on the housing 101, and the moving contact bridge 103 may be movably arranged inside the housing 101 between a conduction position (see FIGS. 4 and 5) where the moving contact bridge 103 is conducted with the static contact bridges 102 and a disconnection position (see FIGS. 2 and 3) where the moving contact bridge 103 is disconnected from the static contact bridges 102. The pushing mechanism 104 may be connected with the moving contact bridge 103. The pushing mechanism 104 may be used for pushing the moving contact bridge 103 to move between the conduction position and the disconnection position. The detection assembly 105 may include an auxiliary moving contact bridge 106 and an auxiliary static contact bridge 107 (see FIG. 3). The auxiliary moving contact bridge 106 may be connected with the pushing mechanism 104, and the auxiliary static contact bridge 107 may be arranged on the housing 101. The auxiliary moving contact bridge 106 may be conducted with the auxiliary static contact bridge 107 when the moving contact bridge 103 is at the conduction position, and the auxiliary moving contact bridge 106 may be disconnected from the auxiliary static contact bridge 107 when the moving contact bridge 103 is at the disconnection position. Thus, whether the static contact bridges 102 and the moving contact bridge 103 of the relay 100 are conducted can be detected through the detection assembly 105. Specifically, the static contact bridges 102 can stretch into the housing 101 so that the moving contact bridge 103 is conducted with the static contact bridges 102 through contact when the moving contact bridge 103 is at the conduction position.

In a specific implementation, the pushing mechanism 104 includes an upper end and a lower end. The upper end is arranged inside the housing 101, and the lower end is arranged outside the housing 101. The auxiliary moving contact bridge 106 is connected with the upper end of the pushing mechanism 104. Specifically, the auxiliary moving contact bridge 106 is arranged inside the housing 101, and the auxiliary static contact bridge 107 can stretch into housing 101 so that the auxiliary static contact bridge 107 can be in contact with the auxiliary moving contact bridge 106.

In case of the relay 100 according to the embodiment of the present subject matter, by detecting the conduction relationship between the auxiliary moving contact bridge 106 and the auxiliary static contact bridge 107, whether the moving contact bridge 103 and the static contact bridges 102 are conducted can be quickly detected on a circuit where the relay 100 is located, thus, the conduction status between the moving contact bridge 103 and the static contact bridges 102 can be detected and fed back in time, thereby improving the operational reliability and safety of the relay 100.

It should be noted that the "the auxiliary moving contact bridge 106 may be conducted with the auxiliary static contact bridge 107 when the moving contact bridge 103 is at the conduction position" includes at least the following conditions.

1) An external circuit is connected with the auxiliary moving contact bridge 106 and the auxiliary static contact bridge 107, respectively. The external circuit can determine that whether the auxiliary moving contact bridge 106 and the auxiliary static contact bridge 107 are conducted, and further can determine the position (conduction position or disconnection position) of the moving contact bridge 103.

2) The auxiliary static contact bridge 107 includes two wires separated from each other, and the external circuit is connected with the two wires of the auxiliary static contact bridge 107. When the moving contact bridge 103 is at the conduction position, the auxiliary moving contact bridge 106 is driven by the pushing mechanism 104 to contact the two wires of the auxiliary static contact bridge 107 so that the two wires are conducted. When the moving contact bridge 103 is at the disconnection position, the auxiliary moving contact bridge 106 is driven by the pushing mechanism 104 to disconnect from the two wires of the auxiliary static contact bridge 107 so that the two wires are disconnected. Thus, whether the auxiliary moving contact bridge 106 and the auxiliary static contact bridge 107 are conducted can be determined through the external circuit, and the position (conduction position or disconnection position) of the moving contact bridge 103 can be further determined.

3) The auxiliary static contact bridge 107 includes a plurality of wires separated from one another, and the external circuit is connected with the plurality of wires of the auxiliary static contact bridge 107; when the moving contact bridge 103 is at the conduction position, the auxiliary moving contact bridge 106 is driven by the pushing mechanism 104 to contact the plurality of wires so that the plurality of wires are conducted; and when the moving contact bridge 103 is at the disconnection position, the auxiliary moving contact bridge 106 is driven by the pushing mechanism 104 to disconnect from the plurality of wires so that the plurality of wires are disconnected; thus, whether the auxiliary moving contact bridge 106 and the auxiliary static contact bridge 107 are conducted can be determined through the external circuit, and the position (conduction position or disconnection position) of the moving contact bridge 103 can be further determined. In addition, by properly setting the positions of the plurality of wires, when the relay 100 fails, the position of the failure can be determined according to the conduction status among the plurality of wires.

Figure 2:
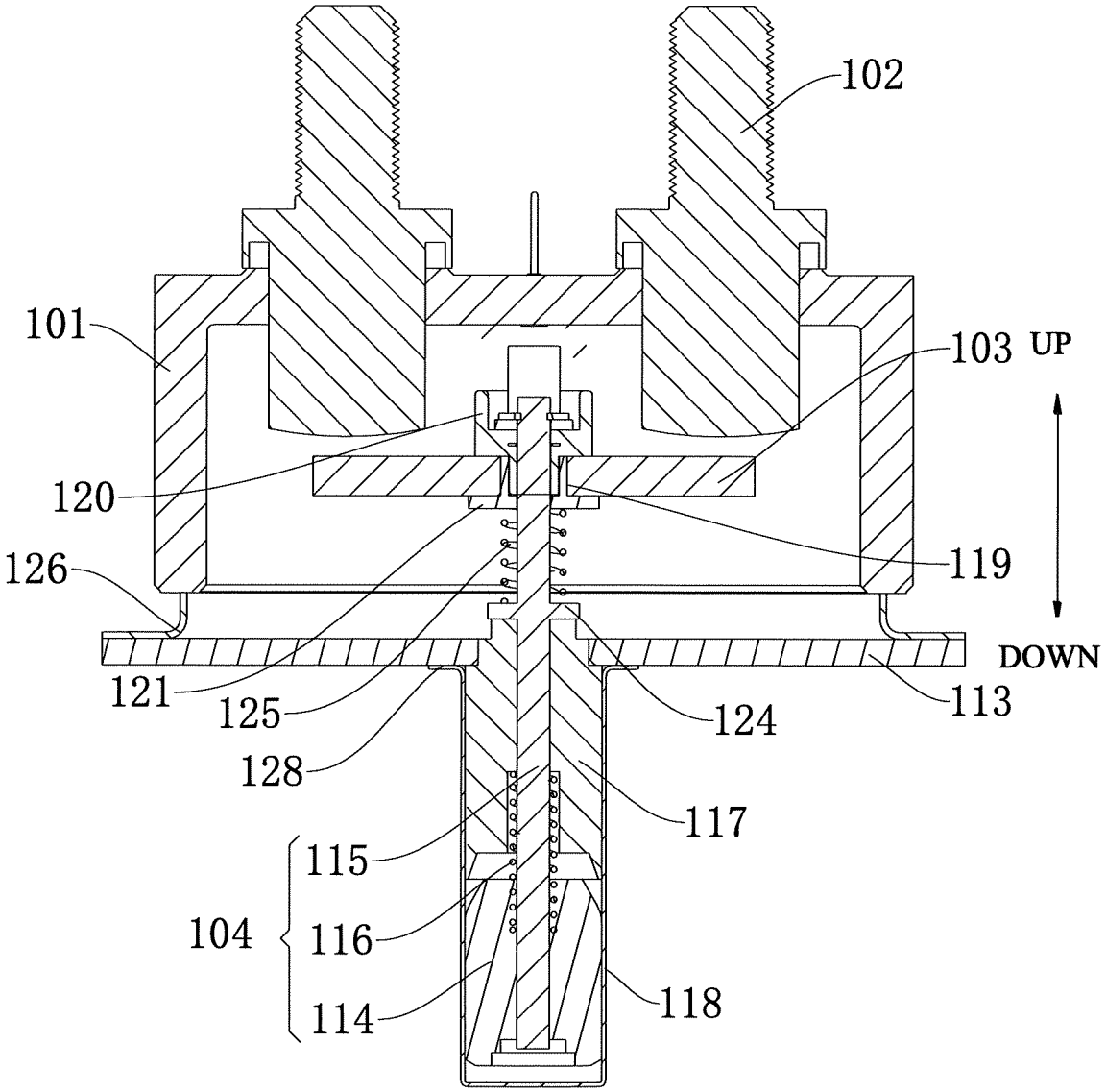
FIG. 2 is a sectional view of the relay in FIG. 1 at an open position.
Figure 3:
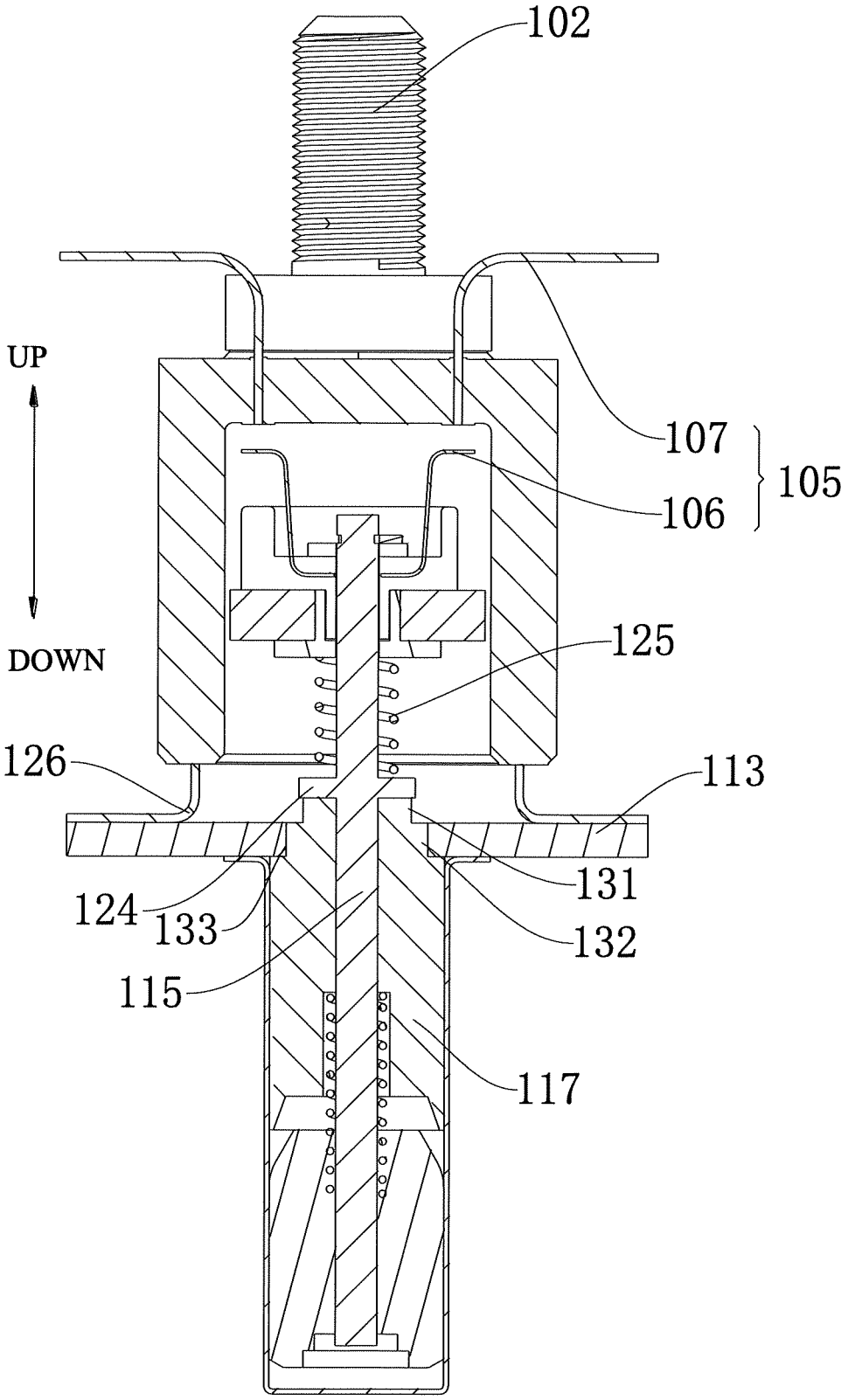
FIG. 3 is another sectional view of the relay in FIG. 1 at the open position.

As shown in FIGS. 2 and 3, the pushing mechanism 104 includes a drive shaft 115, and the auxiliary moving contact bridge 106 may be arranged at the upper end of the drive shaft 115 (e.g., the upper end of the drive shaft 115 in FIG. 2 or 3). Moreover, the auxiliary moving contact bridge 106 may be fixed at the upper end of the drive shaft 115 or slide relative to the drive shaft 115. For example, a limiting member and an elastic member are provided to limit the position of the auxiliary moving contact bridge 106, thereby buffering the auxiliary moving contact bridge 106. Besides, the auxiliary moving contact bridge 106 may also be arranged on the moving contact bridge 103, wherein the moving contact bridge 103 is slidably sleeved at the upper end of the drive shaft 115, and a buffer spring 125 is arranged below the moving contact bridge 103; and the moving contact bridge 103 can be buffered up and down along the drive shaft 115, thereby ensuring the accuracy and smoothness of the detection to some extent.

Figure 5:
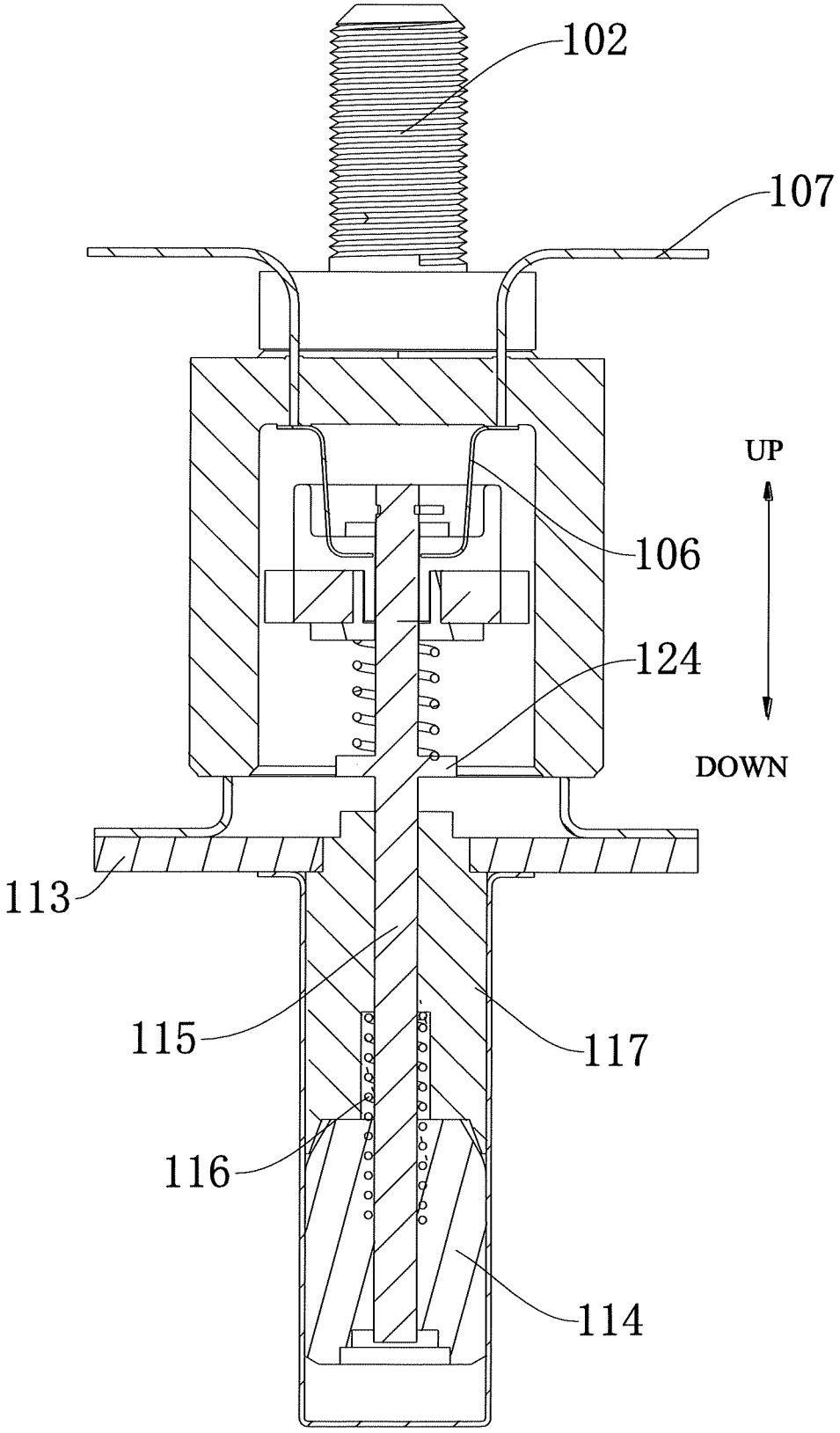
FIG. 5 is another sectional view of the relay in FIG. 1 at the closed position.
Figure 10:
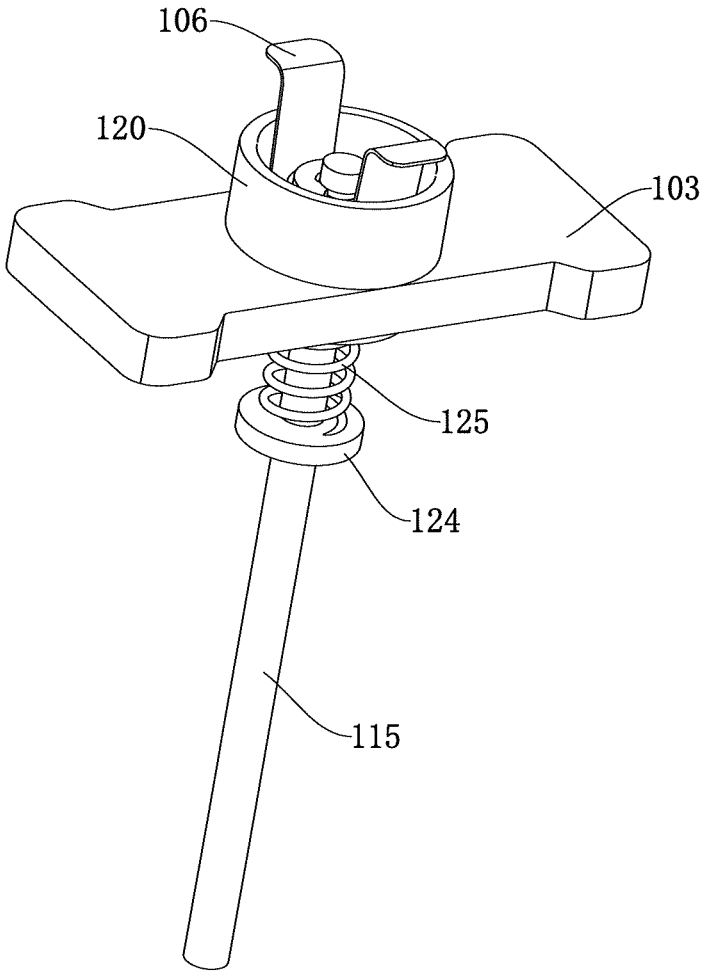
FIG. 10 is a partial view of a pushing mechanism of the relay according to an embodiment of the present subject matter.

As shown in FIG. 5 and FIG. 10, in some embodiments of the present subject matter, the auxiliary moving contact bridge 106 may be an elastic sheet, and the auxiliary static contact bridge 107 may include two wires arranged at an interval. When the moving contact bridge 103 is at the conduction position, the elastic sheet conducts the two wires. When the moving contact bridge 103 is at the disconnection position, the elastic sheet does not conduct the two wires. Whether the two wires are conducted can be detected through an external circuit, and then the position of the moving contact bridge 103 can be determined. Thus, whether the moving contact bridge 103 and the static contact bridges 102 are conducted can be detected, so that the operational reliability of the relay 100 can be improved.

In one embodiment, the auxiliary static contact bridge 107 includes two wires which are conducted when the moving contact bridge 103 is at the conduction position. In one embodiment, the auxiliary static contact bridge 107 includes a plurality of wires, and it is determined that the moving contact bridge 103 is at the conduction position when the plurality of wires are conducted, so that the safety of the relay 100 is further improved.

Of course, the auxiliary static contact bridge 107 may also include one wire, and whether the moving contact bridge 103 has moved to the conduction position is determined by detecting whether the wire is conducted with the auxiliary static contact bridge 107.

The auxiliary moving contact bridge 106 and the auxiliary static contact bridge 107 may also be other components having conductivity. The specific forms of the auxiliary moving contact bridge 106 and the auxiliary static contact bridge 107 are not limited in the present subject matter, and can be adaptively selected according to needs in practical applications.

Figure 7:
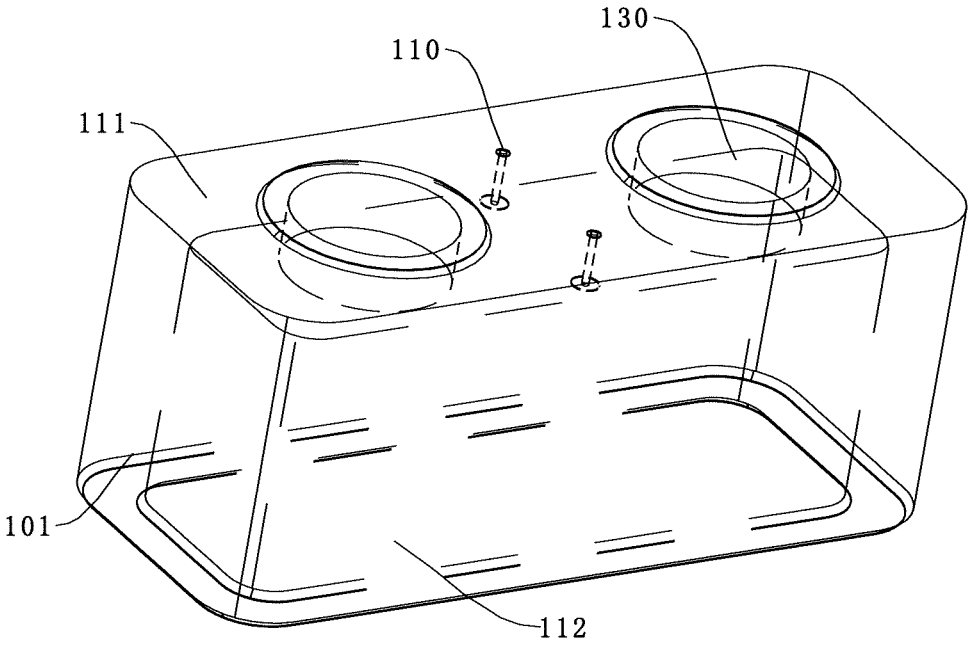
FIG. 7 is a schematic diagram of one embodiment of a housing of the relay according to an embodiment of the present subject matter.
Figure 8:
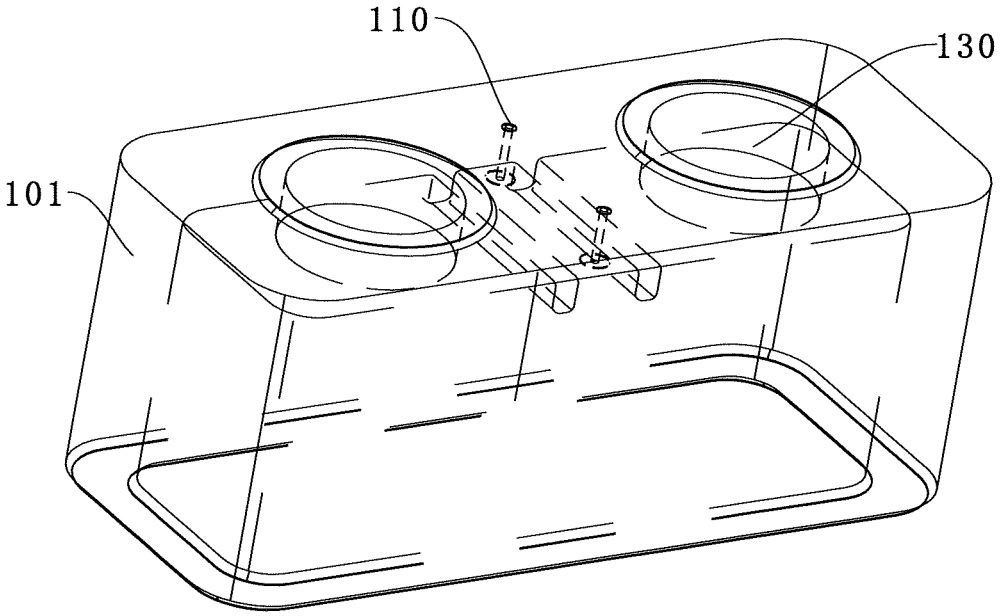
FIG. 8 is a schematic diagram of another embodiment of the housing of the relay according to an embodiment of the present subject matter.
Figure 9:
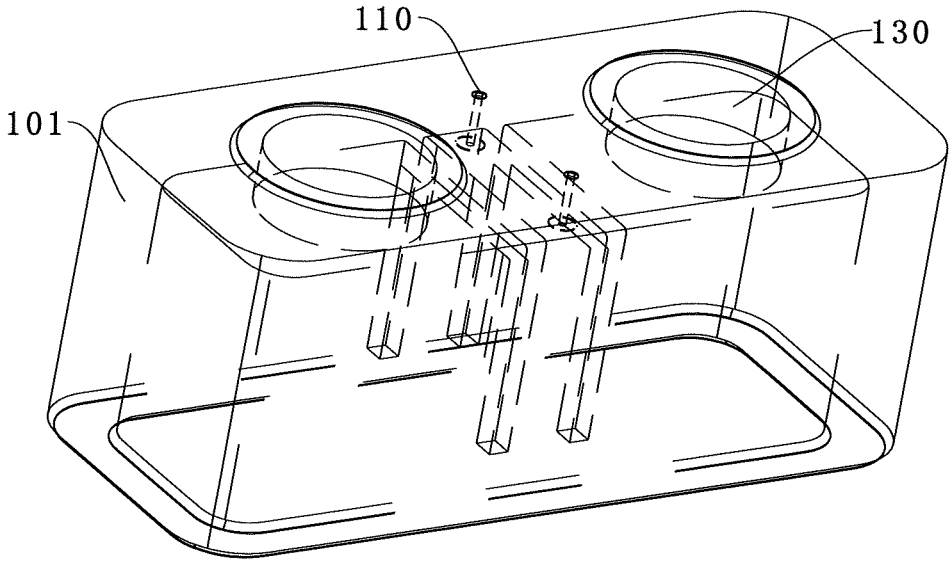
FIG. 9 is a schematic diagram of still another embodiment of the housing of the relay according to an embodiment of the present subject matter.

Further, referring to FIG. 7 to FIG. 9, the housing 101 may be formed with through holes 110, and the inner surfaces of the through holes 110 are provided with metalized layers. Specifically, two through holes 110 may be formed in the housing 101, the auxiliary static contact bridge includes two wires, and the two wires may be respectively inserted into the two through holes 110 and electrically connected with the metalized layer. Thus, a favorable detection condition can be provided for the detection assembly 105.

For example, in the example of FIG. 5, the wire can be inserted into the through hole 110 and electrically connected with the metalized layer, and at the same time, the auxiliary moving contact bridge 106 such as an elastic sheet can be electrically connected with the metalized layer on the lower surface of the through hole 110, thus, the electrical connection between the auxiliary moving contact bridge 106 and the auxiliary static contact bridge 107 can be realized to detect the conduction status of the relay 100.

It can be understood that, referring to FIG. 3, since the metalized layers on the inner surface and the upper and lower surfaces of the through hole 110 have conductivity, when the wire is welded, the accuracy of subsequent detection can be ensured as long as the lower end of the auxiliary static contact bridge 107 such as the wire (e.g., the lower end of the auxiliary static contact bridge 107 in FIG. 3) does not stretch into the cavity of the housing 101.

The housing 101 may be welded with the wire into a whole to ensure the sealing performance of the relay 100.

Referring to FIG. 2 and in combination with FIG. 7, the housing 101 may also be formed with fitting holes 130 for mounting the static contact bridges 102.

The housing 101 may be made of, for example, a ceramic material. Thus, the housing 101 may have good insulation performance and high temperature resistance, so that the service safety of the relay 100 can be ensured to some extent.

The above description about the material of the housing 101 is only exemplary, and it should not be understood as a limitation of the present subject matter. The material of the housing 101 is not specifically limited, and can be adaptively selected according to needs in practical applications.

FIGS. 8 and 9 illustrate housings 101 of relays 100 according to two other embodiments of the present subject matter, wherein in the example of FIG. 8, a blocking structure is added at the bottom of the through hole 110, thus, the auxiliary moving contact bridge 106 such as an elastic sheet can be effectively prevented from swinging, and the creepage distance between the static contact bridges 102 and the auxiliary moving contact bridge 106 can also be increased. In the example of FIG. 9, another kind of blocking structure is added at the bottom of the through hole 110, thus, not only the auxiliary moving contact bridge 106 such as an elastic sheet can be prevented from swinging, but also a separate arc extinguishing chamber can be formed to prevent copper spatter during arc discharge from affecting the detection accuracy of the detection assembly 105.

The specific structural form of the through hole 110 in the housing 101 described above is not limited in the present subject matter, and can be selected adaptively according to needs in practical applications.

As shown in FIGS. 2 and 7, the housing 101 may be in the shape of a frame with an open lower end, the static contact bridges 102 and the auxiliary static contact bridge 107 can be arranged on the top wall 111 of the housing 101 (e.g., the upper end of the housing 101 in FIG. 7), and the lower end 112 of the housing 101 (e.g., the lower end 112 of the housing 101 in FIG. 7) may be connected with an upper yoke 113.

For example, referring to FIG. 2, the relay 100 may further include a connecting table 126, and the lower end 112 of the housing 101 may be connected with the connecting table 126. In other words, the housing 101 may be placed on the connecting table 126, wherein the upper yoke 113 may be arranged below the connecting table 126, and the lower end face of the connecting table 126 may be fitted with the upper surface of the upper yoke 113. Thus, the structural stability of the relay 100 may be ensured to some extent. Further, as shown in FIG. 2, the pushing mechanism 104 may include a moving core 114, a drive shaft 115 and a reset spring 116. The lower end of the drive shaft 115 (e.g., the lower end of the drive shaft 115 in FIG. 2) may be connected with the moving core 114 and the relative position between the drive shaft 115 and the moving core 114 may be fixed, and a static core 117 which extends down and is sleeved on the outer side of the drive shaft 115 (e.g., the side far from the center line of the drive shaft 115 in FIG. 2) is arranged on the upper yoke 113. The upper end of the drive shaft 115 (e.g., the upper end of the drive shaft 115 in FIG. 2) penetrates through the static core 117 and is connected with the moving contact bridge 103. The reset spring 116 is sleeved outside the drive shaft 115 and the two ends of the reset spring 116 (e.g., the lower and upper ends of the reset spring 116 in FIG. 2) are connected with the moving core 114 and the static core 117, respectively. Thus, the moving core 114 can move up and down to drive the drive shaft 115 to move up and down, so that the moving contact bridge 103 of the relay 100 can be switched between the conduction position and the disconnection position.

Further, referring to FIG. 2 and in combination with FIG. 1, a sleeve 118 may be provided below the upper yoke 113, the sleeve 118 may be sleeved outside the static core 117, and the moving core 114 may be slidably sleeved in the sleeve 118 along the up and down direction (e.g., the up and down direction shown in FIG. 2).

As shown in FIG. 3, the upper end of the static core 117 (e.g., the upper end of the static core 117 in FIG. 3) may be provided with a first boss 131 and a second boss 132, and the first boss 131 may be located above the second boss 132. Referring to FIG. 3 and in combination with FIG. 6, the upper yoke 113 may be further provided with a positioning hole 133 suitable for positioning the second boss 132.

As shown in FIG. 2, the upper end of the sleeve 118 may be provided with a limiting turn-up edge 128 which may be fitted with the lower end face of the upper yoke 113, and the sleeve 118 may be sleeved on the periphery of the moving core 114 and the static core 117 to limit the moving core 114 and the static core 117, so that the operational accuracy of the relay 100 can be ensured.

The sleeve 118 may be fixed with the upper yoke 113 by laser welding or threaded connection or other ways.

Figure 6:
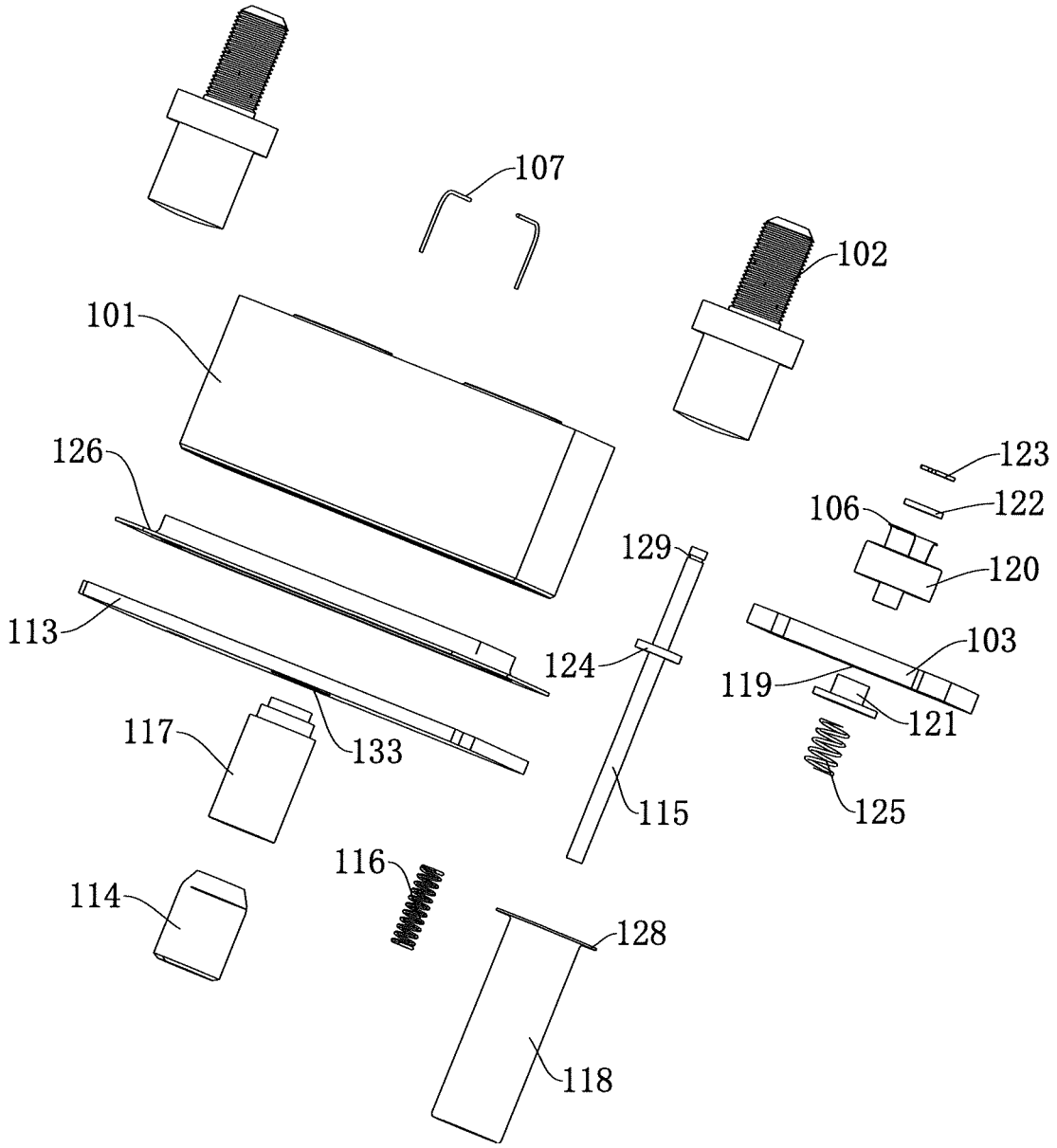
FIG. 6 is an exploded view of FIG. 1.

Optionally, referring to FIG. 2 and in combination with FIG. 6, the moving contact bridge 103 may be formed with a mounting hole 119, the upper end of the drive shaft 115 may penetrate through the mounting hole 119, and the moving contact bridge 103 may be provided with an upper insulating cover 120 and a lower insulating cover 121. The upper insulating cover 120 may be arranged on the moving contact bridge 103 and sleeved outside the drive shaft 115, and the lower end of the upper insulating cover 120 may stretch into the mounting hole 119. The lower insulating cover 121 may be arranged below the moving contact bridge 103 and sleeved outside the drive shaft 115, the upper end of the lower insulating cover 121 may stretch into the mounting hole 119 and be sleeved on the outer side surface of the lower end of the upper insulating cover 120, and the upper insulating cover 120 is in interference fit with the lower insulating cover 121. Thus, the drive shaft 115 can be isolated from the moving contact bridge 103, and thus the high and low voltage components can be isolated to prevent the low voltage components from being damaged or broken down, so that the quality and service safety of the relay 100 can be improved.

In the examples of FIGS. 2 and 6, the upper insulating cover 120 and the lower insulating cover 121 may be formed substantially in a hollow stepped tube shape, and the upper insulating cover 120 and the lower insulating cover 121 may be made of plastic, for example.

It should be noted that, the above descriptions about the shape and material of the upper insulating cover 120 and the lower insulating cover 121 are only exemplary, and should not be understood as a limitation to the present subject matter. Of course, the upper insulating cover 120 and the lower insulating cover 121 may also be made of other materials such as non-metallic materials, which can be adaptively adjusted as needed in practical applications.

Further, referring to FIG. 6 and in combination with FIG. 2, upper end of the drive shaft 115 (e.g., the upper end of the drive shaft 115 in FIG. 2) may be provided with a washer 122 and a clamping spring 123, and the washer 122 may be arranged between the clamping spring 123 and the upper insulating cover 120. Thus, the sealing property of the relay 100 can be ensured.

As shown in FIG. 6, the upper end of the drive shaft 115 may be provided with an annular card slot 129, the clamping spring 123 may be clamped in the annular card slot 129, and the washer 122 may be arranged between the clamping spring 123 and the upper insulating cover 120. The washer 122 can reduce the stress on the clamping spring 123 so as to prevent the clamping spring 123 from dropping.

Optionally, as shown in FIGS. 2 and 10, a limiting flange 124 (see FIG. 10) may be provided on the peripheral surface of the portion of the drive shaft 115 extending upwardly out of the upper yoke 113, and a buffer spring 125 may be sleeved on the outer side of the drive shaft 115 (e.g., the side far from the center line of the drive shaft 115 in FIG. 2). The upper end of the buffer spring 125 (e.g., the upper end of the buffer spring 125 in FIG. 2) can be connected with the lower insulating cover 121, and the lower end of the buffer spring 125 (e.g., the lower end of the buffer spring 125 in FIG. 2) can be connected with the limiting flange 124, so that the operation of the drive shaft 115 can be milder.

The limiting flange 124 on the drive shaft 115 can abut against the upper end of the first boss 131 of the static core 117, thereby ensuring the clearance between the moving contact bridge 103 and the static contact bridges 102, and then ensuring the operational accuracy of the auxiliary moving contact bridge 106 and the auxiliary static contact bridge 107.

Optionally, the auxiliary moving contact bridge 106 and the upper insulating cover 120 can be integrally molded by injection molding. Thus, the machining process can be simplified and the cost can be reduced.

The upper insulating cover 120 and the auxiliary moving contact bridge 106 such as an elastic sheet are integrally molded by injection molding, thereby increasing the creepage distance between main contacts (including the moving contact bridge 103 and the static contact bridges 102) and auxiliary contacts (including the auxiliary moving contact bridge 106 and the auxiliary static contact bridge 107), and ensuring the safety of the auxiliary circuit. Copper cuttings on the wire can be prevented from splashing into the upper insulating cover 120 and the lower insulating cover 121 during arc discharge to conduct the main contacts (including the moving contact bridge 103 and the static contact bridges 102) with the auxiliary contacts (including the auxiliary moving contact bridge 106 and the auxiliary static contact bridge 107) to destroy the determination accuracy and safety of the auxiliary circuit.

The upper insulating cover 120 and the auxiliary moving contact bridge 106 such as an elastic sheet can be integrally molded by injection molding and placed at the upper end of the moving contact bridge 103. The auxiliary moving contact bridge 106 such as an elastic sheet is driven by the drive shaft 115 to move up and down to conduct or disconnect the auxiliary moving contact bridge 106 with or from the auxiliary static contact bridge 107 such as a wire which is electrically connected with the metalized layer on the upper housing 101, so as to detect whether the moving contact bridge 103 and the static contact bridges 102 are conducted or their sticking fails. The auxiliary static contact bridge 107 such as a wire and the housing 101 can be welded together with silver copper, so that the sealing property of the relay 100 can be ensured.

In some embodiments of the present subject matter, as shown in FIG. 2 and FIG. 3, the upper insulating cover 120 and the lower insulating cover 121 are arranged between the drive shaft 115 and the moving contact bridge 103, and the auxiliary moving contact bridge 106 is arranged on the upper insulating cover 120. Thus, the moving contact bridge 103 moving up and down along the drive shaft 115 can be buffered to ensure the accuracy and smoothness of detection.

According to some embodiments of the present subject matter, referring to FIG. 3 and in combination with FIG. 2, the auxiliary moving contact bridge 106 is arranged at the upper end of the pushing mechanism 104 (e.g., the upper end of the pushing mechanism 104 in FIG. 2), thereby improving the response speed of detection, and improving the service performance of the relay 100.

In some embodiments of the present subject matter, referring to FIG. 3 and in combination with FIG. 2, the auxiliary moving contact bridge 106 is arranged at the upper end of the drive shaft 115. Thus, the auxiliary moving contact bridge 106 and the auxiliary static contact bridge 107 can be driven by the up-down movement of the drive shaft 115 to contact with or separated from each other, so that on and off of the relay 100 can be detected.

The working process of the relay 100 according to an embodiment of the present subject matter will be described in detail below with reference to FIGS. 1 to 10.

Specifically, as shown in FIG. 2 and FIG. 3, at this time, the relay 100 is at the disconnection position, the moving contact bridge 103 is disconnected from the static contact bridges 102, the relay 100 is not turned on, the auxiliary moving contact bridge 106 such as an elastic sheet is disconnected from the metalized layer on the housing 101 at the same time, and a certain signal can be given to the wire by, for example, a resistance method, so that the circuit in a disconnected state can be detected, proving that the relay 100 is not turned on.

Figure 4:
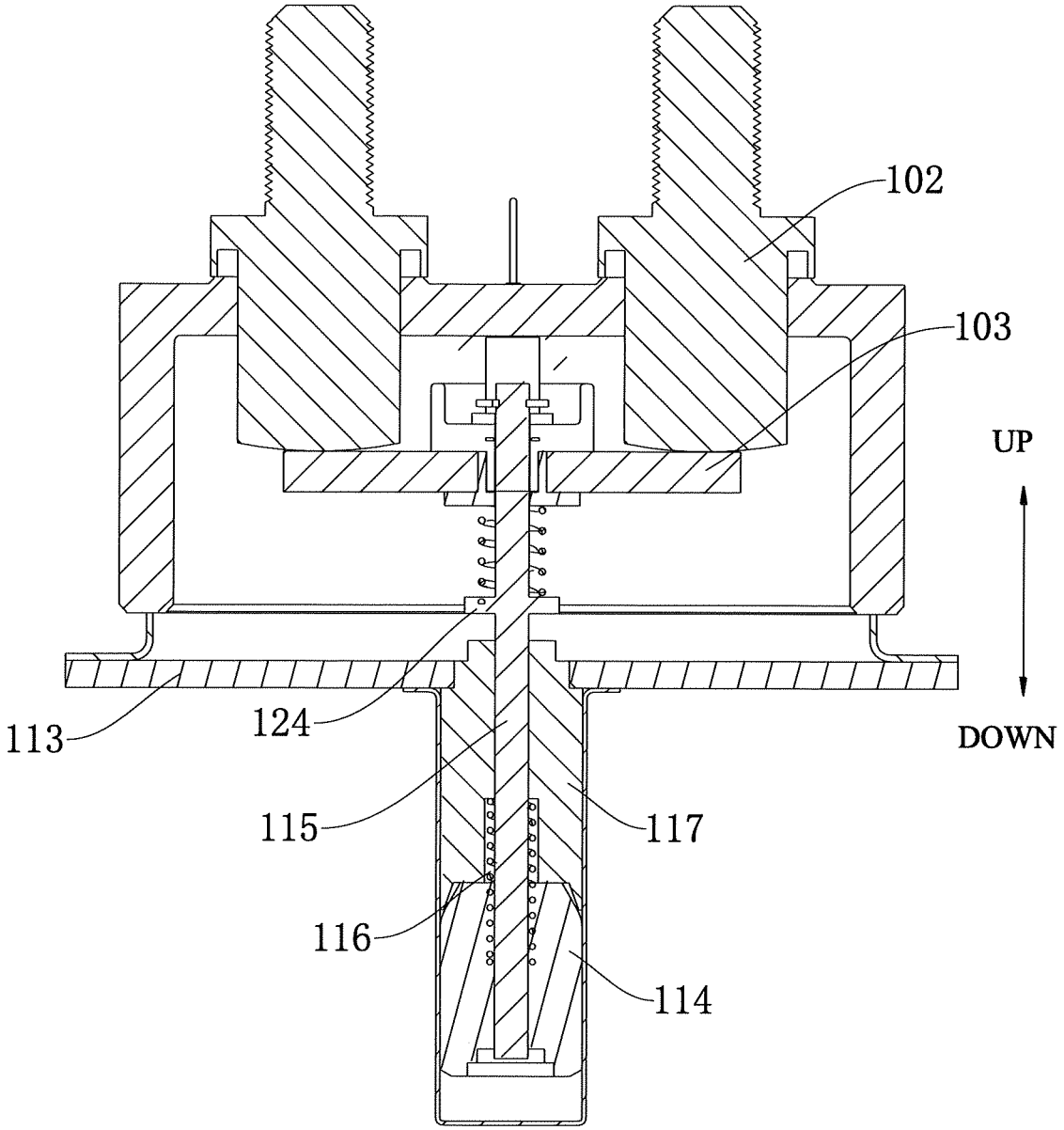
FIG. 4 is a sectional view of the relay in FIG. 1 at a closed position.

As shown in FIG. 4 and FIG. 5, at this time, the relay 100 is at the conduction position under the pushing of the pushing mechanism 104, the moving contact bridge 103 is in contact with the static contact bridges 102, the relay 100 works normally, the auxiliary moving contact bridge 106 such as an elastic sheet can be driven by the drive shaft 115 at the same time to contact the metalized layer of the housing 101 to achieve electrical connection, and a certain signal can be given to the wire by, for example, a resistance method, so that the circuit in a conducted state can be detected, proving that the relay 100 is working normally. The working process of the relay 100 according to an embodiment of the present subject matter is completed so far.

In the description of this specification, it should be understood that the terms "center", "longitudinal", "transverse", "length", "width", "thickness", "upper", "lower", "front", "back", "left", "right", "vertical", "horizontal", "top", "bottom", "inner", "outer", "clockwise", "anticlockwise", "axial", "radial", "circumferential" and the like indicate the orientations or positional relationships based on the orientations or positional relationship shown in the drawings. The terms are only for description convenience of the present subject matter and simplification of the description, but do not indicate or imply that the pointed devices or units must have specific orientations or be constructed and operated in specific orientations. Therefore, the terms should not be understood to limit the present subject matter.

Furthermore, the terms "first" and "second" are only for the sake of description, and cannot be understood as indicating or implying the relative importance or implicitly indicating the quantity of the indicated technical features. Thus, the features defined with "first" or "second" may explicitly indicate or implicitly include at least one of the features. In the description of the present subject matter, "a plurality of" means at least two, e.g., two, three, etc., unless otherwise specified.

In the description of the present subject matter, unless otherwise specified, the terms "installed", "connected", "fixed" and the like all should be generally understood, for example, the "connected" may be fixedly connected, detachably connected, integrally connected, mechanically connected, electrically connected, directly connected, indirectly connected through a medium, communication of interiors of two components or interaction of two components, unless otherwise specified. Those of ordinary skill in the art can understand the specific meanings of the above terms in the present subject matter according to specific circumstances.

In the present subject matter, unless otherwise specified, the first feature "on" or "below" the second feature may be direct contact of the first and second features, or indirect contact of the first and second features through a medium. Moreover, the first feature "on", "above" and "up" the second feature may be the first feature right above or obliquely above the second feature, or merely indicates that the level of the first feature is higher than that of the second feature. The first feature "below", "under" and "down" the second feature may be the first feature right below or obliquely below the second feature, or merely indicates that the level of the first feature is lower than that of the second feature.

In the description of this specification, the terms "one embodiment", "some embodiments", "an example", "a specific embodiment", or "some examples" and the like mean that specific features, structures, materials or characteristics described in conjunction with the embodiments or examples are included in at least one embodiment or example of the present subject matter. In this specification, the schematic descriptions of the above terms do not necessarily refer to the same embodiment or example. Moreover, the specific features, structures, materials or characteristics described can be combined appropriately in one or more embodiments or examples. In addition, different embodiments or examples described in this specification and features of different embodiments or examples can be combined by those skilled in the art without conflicting with each other.

Although the embodiments of the present subject matter have been shown and described above, it could be understood that the above-described embodiments are exemplary and cannot be understood as limiting the present subject matter. Changes, modifications, substitutions and variations may be made to the above embodiments by those of ordinary skill in the art within the scope of the present subject matter.

What is claimed is:

1. A relay comprising:

a housing;

static contact bridges, arranged on the housing;

a moving contact bridge, movably arranged in the housing between a conduction position where the moving contact bridge is conducted with the static contact bridges and a disconnection position where the moving contact bridge is disconnected from the static contact bridges;

a pushing mechanism, connected with the moving contact bridge and used for pushing the moving contact bridge to move between the conduction position and the disconnection position, wherein the pushing mechanism comprises an upper end and a lower end, the upper end of the pushing mechanism is arranged inside the housing, and the lower end of the pushing mechanism is arranged outside the housing; and a detection assembly, comprising an auxiliary moving contact bridge and an auxiliary static contact bridge, wherein the auxiliary moving contact bridge is connected with the pushing mechanism, the auxiliary static contact bridge is arranged on the housing, the auxiliary moving contact bridge is connected with the auxiliary static contact bridge when the moving contact bridge is at the conduction position, and the auxiliary moving contact bridge is disconnected from the auxiliary static contact bridge when the moving contact bridge is at the disconnection position.

2. The relay according to claim 1, wherein the auxiliary moving contact bridge is an elastic sheet, the auxiliary static contact bridge comprises two wires arranged at an interval, and the elastic sheet conducts the two wires when the moving contact bridge is at the conduction position.

3. The relay according to claim 2, wherein the housing is formed with through holes, a metalized layer is formed on the inner surfaces of the through holes, and the wires are inserted into the through holes and electrically connected with the metalized layer.

4. The relay according to claim 1, wherein the housing is in the shape of a frame with an open lower end, the static contact bridges and the auxiliary static contact bridge are arranged on the top wall of the housing, and an upper yoke is connected to the lower end of the housing.

5. The relay according to claim 4, wherein the pushing mechanism comprises:

a moving core;

a drive shaft, wherein the lower end of the drive shaft is connected with the moving core and the relative position therebetween is fixed, a static core extending down and sleeved outside the drive shaft is arranged on the upper yoke, and the upper end of the drive shaft penetrates through the static core and is connected with the moving contact bridge; and a reset spring, wherein the reset spring is sleeved outside the drive shaft and the two ends are respectively connected with the moving core and the static core.

6. The relay according to claim 5, wherein a sleeve is arranged below the upper yoke, the sleeve is sleeved outside the static core, and the moving core is slidably sleeved in the sleeve along the upper and lower direction.

7. The relay according to claim 5, wherein a mounting hole is formed in the moving contact bridge, the upper end of the drive shaft penetrates through the mounting hole, and the moving contact bridge is provided with:

an upper insulating cover, arranged on the moving contact bridge and sleeved outside the drive shaft, the lower end of the upper insulating cover stretching into the mounting hole; and a lower insulating cover, arranged below the moving contact bridge and sleeved outside the drive shaft, the upper end of the lower insulating cover stretching into the mounting hole and sleeved on the outer side surface of the lower end of the upper insulating cover, and the upper insulating cover being in interference fit with the lower insulating cover.

8. The relay according to claim 7, wherein a washer and a clamping spring are arranged at the upper end of the drive shaft, and the washer is arranged between the clamping spring and the upper insulating cover.

9. The relay according to claim 7, wherein a limiting flange is provided on the peripheral surface of the portion of the drive shaft extending upwardly out of the upper yoke, a buffer spring is sleeved on the outer side of the drive shaft, the upper end of the buffer spring is connected with the lower insulating cover and the lower end is connected with the limiting flange.

10. The relay according to claim 7, wherein the auxiliary moving contact bridge and the upper insulating cover are integrally molded by injection molding.

11. The relay according to claim 5, wherein an upper insulating cover and a lower insulating cover are arranged between the drive shaft and the moving contact bridge, and the auxiliary moving contact bridge is arranged on the upper insulating cover.

12. The relay according to claim 1, wherein the auxiliary moving contact bridge is arranged at the upper end of the pushing mechanism.

13. The relay according to claim 5, wherein the auxiliary moving contact bridge is arranged at the upper end of the drive shaft.

14. The relay according to claim 1, wherein the auxiliary moving contact bridge is an elastic sheet, the auxiliary static contact bridge comprises two wires arranged at an interval, and the elastic sheet conducts the two wires when the moving contact bridge is at the conduction position.

15. The relay according to claim 1, wherein the housing is in the shape of a frame with an open lower end, the static contact bridges and the auxiliary static contact bridge are arranged on the top wall of the housing, and an upper yoke is connected to the lower end of the housing.

16. The relay according to claim 2, wherein the housing is in the shape of a frame with an open lower end, the static contact bridges and the auxiliary static contact bridge are arranged on the top wall of the housing, and an upper yoke is connected to the lower end of the housing.

17. The relay according to claim 3, wherein the housing is in the shape of a frame with an open lower end, the static contact bridges and the auxiliary static contact bridge are arranged on the top wall of the housing, and an upper yoke is connected to the lower end of the housing.

18. The relay according to claim 14, wherein the housing is in the shape of a frame with an open lower end, the static contact bridges and the auxiliary static contact bridge are arranged on the top wall of the housing, and an upper yoke is connected to the lower end of the housing.

19. The relay according to claim 11, wherein the auxiliary moving contact bridge is arranged at the upper end of the pushing mechanism.

* * * * *